United States Patent [19]

Ginzburg

[11] Patent Number: 4,771,622

[45] Date of Patent: Sep. 20, 1988

[54] STRIP ROLLING MILL APPARATUS

[75] Inventor: Vladimir B. Ginzburg, Pittsburgh, Pa.

[73] Assignees: International Rolling Mill Consultants Inc.; United Engineering Rolling Mills, Inc., both of Pittsburgh, Pa.

[21] Appl. No.: 839,037

[22] Filed: Mar. 12, 1986

[51] Int. Cl.[4] ..... B21B 37/12; G01L 5/04

[52] U.S. Cl. ..... 72/8; 72/11; 72/16; 72/17; 73/862.07

[58] Field of Search ..... 72/234, 226, 8–12, 72/16, 17; 73/862.07, 159

[56] References Cited

U.S. PATENT DOCUMENTS

| | | | |
|---|---|---|---|
| 3,170,344 | 2/1965 | Marrs | 80/35 |
| 3,315,506 | 4/1967 | Schneider | 72/9 |
| 3,406,547 | 10/1968 | List | 72/8 |
| 3,475,935 | 11/1969 | Kajiwara | 72/9 |
| 3,592,031 | 7/1971 | Sutton et al. | 72/8 |
| 3,722,244 | 3/1973 | Fujii et al. | 72/16 |
| 3,731,508 | 5/1973 | Sabatini et al. . | |
| 3,756,050 | 9/1973 | Kubo et al. | 72/9 |
| 3,808,857 | 5/1974 | Connors | 72/8 |
| 3,869,892 | 3/1975 | Highman et al. | 72/9 |
| 3,882,709 | 5/1975 | Kawamoto et al. | 72/234 |
| 4,030,326 | 6/1977 | Morooka et al. | 72/8 |
| 4,244,025 | 1/1981 | Alshuk | 364/472 |
| 4,299,103 | 11/1982 | Marten | 72/16 |
| 4,428,054 | 1/1984 | Aizawa et al. | 34/472 |
| 4,485,497 | 12/1984 | Miura | 364/469 |
| 4,494,205 | 1/1985 | Dairiki et al. | 364/472 |
| 4,711,109 | 12/1987 | Rohde et al. | 72/17 X |

FOREIGN PATENT DOCUMENTS

| | | | |
|---|---|---|---|
| 0121148 | 10/1984 | European Pat. Off. | 72/234 |

OTHER PUBLICATIONS

Wilms et al., "Profile and Flatness Control in Hot Strip Mills", *Metallurgical Plant and Technology,* Jun. 1985, pp. 74–90.

*Primary Examiner*—Robert L. Spruill
*Assistant Examiner*—Steven B. Katz
*Attorney, Agent, or Firm*—Arnold B. Silverman; Suzanne Kikel

[57] ABSTRACT

A multistand tandem strip rolling mill and associated method wherein effective control of gauge and shape are provided. Shape monitoring sensors may be provided adjacent to a first mill stand and adjacent to a downstream mill stand in order to provide feedback-feedforward information regarding strip shape and gauge to controller units which when a predetermined shape has not been achieved issues a control signal to adjust the actuators. A computer preferably has stored information regarding the desired shape and gauge effects a comparison between the signals received from the shape and gauge sensors.Gauge sensors may be provided adjacent to the shape sensors. The mill stands preferably have roll bending cylinders positioned by roll bending system servo-valves which are actuated by signals from the controller.

9 Claims, 6 Drawing Sheets

STRIP ROLLING MILL APPARATUS

BACKGROUND OF THE INVENTION

1. Field of the Invention

This invention relates to apparatus and a method for effecting prompt, precise control of shape and gauge of strip being rolled in a multistand tandem strip rolling mill.

2. Description of the Prior Art

The need to maintain effective control over the gauge and shape of metal being reduced by rolling mills has been known. Maintaining the desired metal profile becomes more difficult with respect to metal strip and is enhanced as the strip is reduced in thickness.

A further problem is that the existing systems present problems in respect of maintenance as it is generally required to stop the rolling process in order to remove shapemeter sensors and to reinstall the same after repair. It has been known to monitor shape or gauge downstream of a single stand or downstream of the last stand of a multistand mill and to employ this information in adjusting mill settings. See U.S. Pat. Nos. 3,756,050; 3,731,508; and 3,882,709.

It has also been known to employ noncontacting magnetic detectors in attempting to control shape of metal strip in a single stand mill. See U.S. Pat. No. 3,756,050. U.S. Pat. Nos. 3,475,935 and 3,315,506 also disclose systems wherein downstream sensing is employed as a means for attempting to adjust a mill.

U.S. Pat. No. 3,592,031 discloses the use in a tandem mill of upstream and downstream detectors along with computerized processing to control gauge. See also U.S. Pat. No. 3,869,892.

None of the prior patents teach or suggest a system wherein high speed correction of shape and gauge may be effected in a tandem strip rolling mill by feed forward-feedback means.

SUMMARY OF THE INVENTION

The present invention has met the above-described need by providing an effective sensor and computerized control system for promptly adjusting a strip rolling mill in respect of shape and gauge.

In a preferred embodiment of the invention, the multistand strip rolling mill, which may be a tandem mill, has a first mill stand and at least one additional mill stand. Each stand will have a pair of work rolls and roll bite contour actuator means for altering the roll bite contour. First sensor means are disposed adjacent to and preferably downstream of the first mill stand for providing signals corresponding to strip shape adjacent to the first mill stand. Second shape sensor means are disposed adjacent to and preferably downstream of the last mill stand for providing signals corresponding to the strip characteristics adjacent the exit. The signals from the first and second shape sensing means are delivered to a controller which preferably contains a computer having stored information regarding the desired shape and gauge. After a comparison is effected between the stored information and the signals from the two sensor means, if an adjustment is needed, a control signal is emitted to effect a change in one or more mill stands.

The method of the invention involves controlling the shape of strip by monitoring strip shape adjacent to the first mill stand and adjacent to the last mill stand, effecting a comparison between the shape signals and the desired shape and where appropriate emitting a control signal to effect a change in mill stand settings.

It is an object of the present invention to provide apparatus and a related method of controlling strip shape and gauge in a multistand rolling mill.

It is another object of the present invention to provide for correction in departures from desired shape or gauge at an early stage in hot or cold rolling.

It is a further object of the invention to provide rapid correction of any departures from desired tolerances in rolling of strip in a multistand mill.

It is a further object of the present invention to accomplish these objectives without requiring major alterations to existing rolling mill systems.

It is a further object of the present invention to provide shape sensors which may be serviced without requiring prolonged mill shutdown.

These and other objects of the invention will be more fully understood from the following description of the invention, on reference to the illustrations appended hereto.

DESCRIPTION OF THE PREFERRED EMBODIMENT

Figure 1:
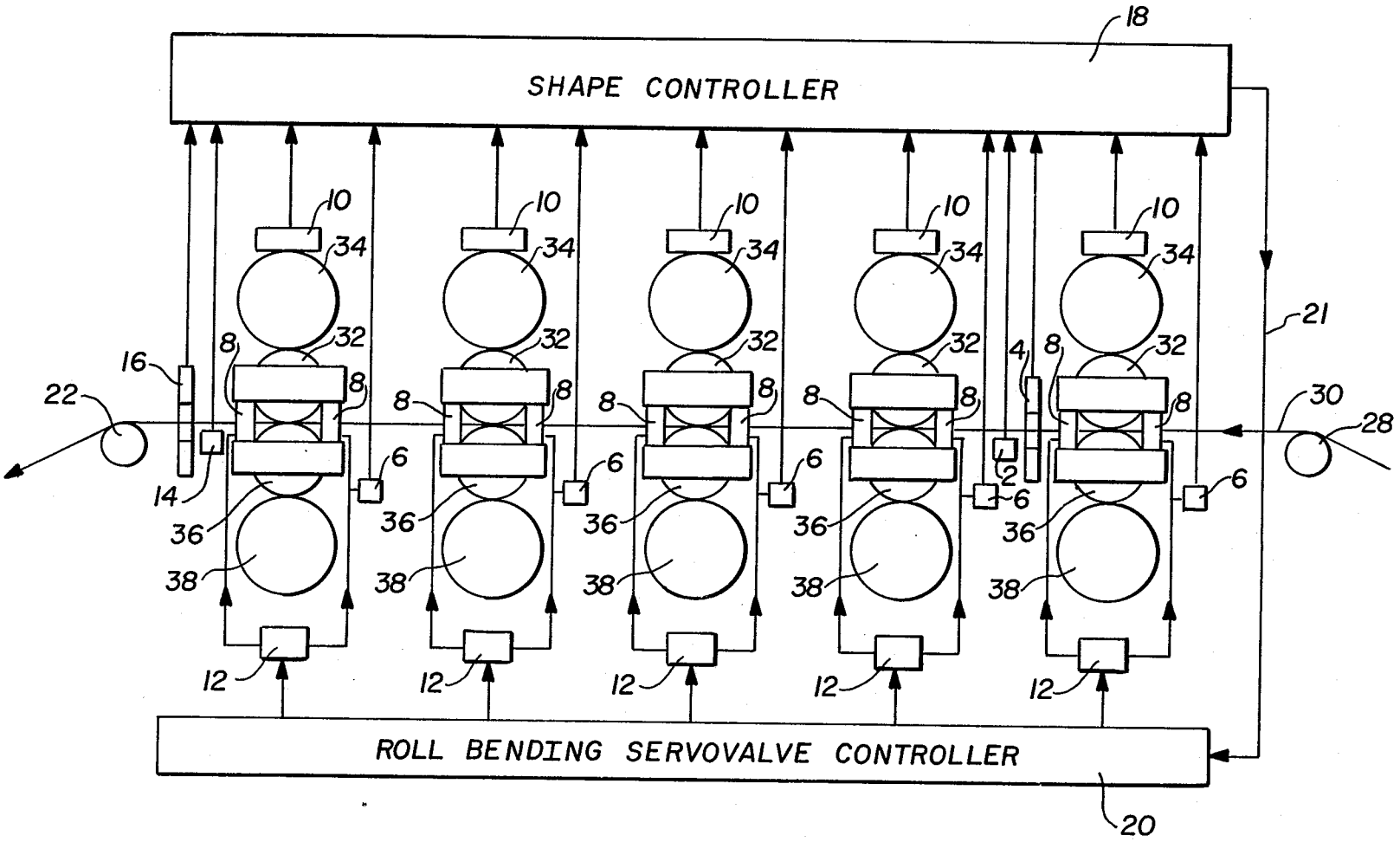
FIG. 1 is a schematic illustration of a multistand mill incorporating the apparatus of the present invention.

Referring more specifically to FIG. 1, there is shown a five stand strip rolling mill wherein the strip travels from right to left (as indicated by the arrows) as it passes through the mill. Disposed adjacent to and immediately downstream of the first stand is an array of shape sensing means 2 the details of which will be described hereinafter. Adjacent to the first shape sensing means 2 is a gauge sensor 4. A series of roll bending system pressure transducers 6 are disposed adjacent to each stand and provide an output signal responsive to the pressure in the lines which connect the roll bending cylinders 8 which provide adjustments to compensate for crown-in and crown-out conditions and receive fluid under pressure from an associated servovalve 12. Each mill stand also has a load cell 10 which provides an output signal corresponding to roll force.

Located adjacent to and in the form shown downstream of the last mill stand are second shape sensor means 14 and a second gauge sensor 16. It will be appreciated that while the illustrated embodiment having the shape sensing means 2 and gauge sensor 4 disposed downstream of the first mill stand and the shape sensor 14 and gauge sensor 16 disposed downstream of the last mill stand is preferred it is not essential. The feedforward-feedback concepts of the present invention contemplate sensing at different stand positions and where appropriate effecting rapid corrective action in either an upstream or downstream direction.

Controller means which, in the form shown, consist of a shape controller 18 and roll bending servovalve controller 20 contain a computer unit programmed with the desired shape and gauge information. Feedback information provided by the first and second shape sensor means 2, 14 and first and second gauge sensors 4, 16 as well as the roll bending system pressure transducers 6 and load cells 10 permit comparison of readings both adjacent to the first mill stand and the last mill stand with the desired shape and gauge information. When there is a departure of a predetermined magnitude of the feedback signals (containing actual shape and gauge information) from the stored information, a control system signal is emitted by shape controller 18 to roll bending servovalve controller 20 over line 21. This results in an adjustment being made to the roll bending system servovalves 12 which in turn creates an adjustment in roll bending cylinders 8 to thereby correct for the undesired deviation. As a result of providing feedback from both the upstream and downstream portions of the multistand mill, combined with the computerized processing and adjustment to the servovalves, prompt and effective control of the strip is achieved.

While the system illustrated is a tandem mill having five mill stands, it will be appreciated that the mill may include a greater or lesser number and that in general, the system is applicable to any systems having two or more stands.

In general, identical numbers have been employed for like parts in the mill stands for simplicity of disclosure. In operation, the strip 30 will be supported at the entry end by roll 28 and at the exit end by roll 22. While in the form illustrated each stand has not only a pair of work rolls 32, 36, but also a pair of backup rolls 34, 38, it will be appreciated that the system may be employed with just work rolls, if desired.

Figure 2:
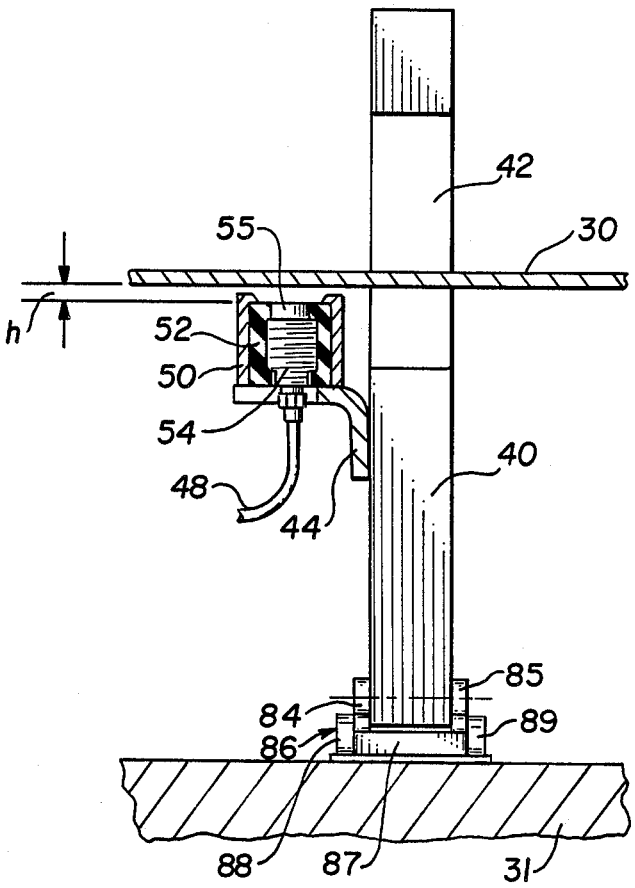
FIG. 2 is a fragmentary, cross-sectional illustration showing a preferred form of sensor positioned in a mill stand.
Figure 3:
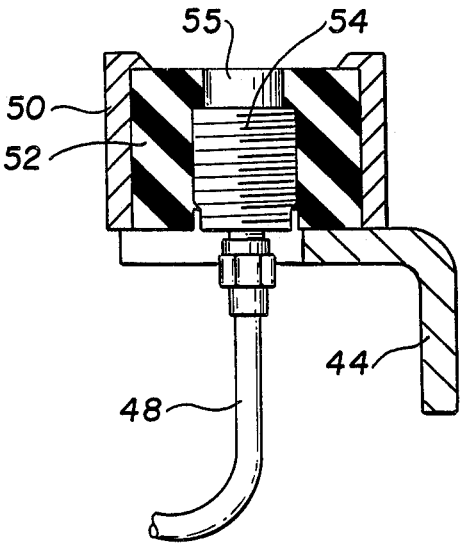
FIG. 3 is an enlarged cross-sectional illustration of a form of sensor employed in the present invention.
Figure 4:
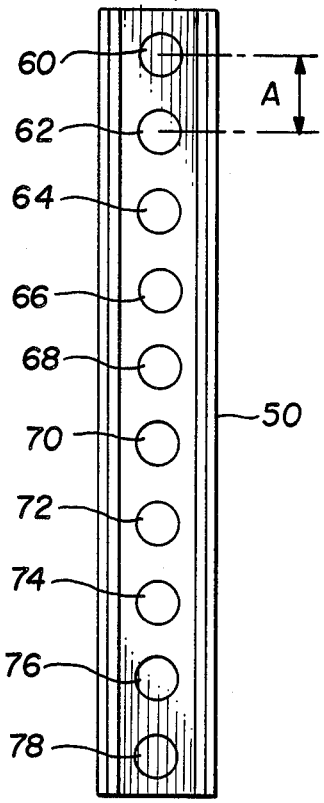
FIG. 4 is a top plan view of a sensor array which may be employed within the present invention.

Referring now to FIGS. 2 through 4 another preferred feature of the present invention will be considered. As is shown in these figures, the strip 30 passes through an opening 42 in gauge detector 40. An array of noncontacting sensors which has its upper surface spaced a distance h from the lower surface of strip 30 is provided. In general, the spacing h may be preferably about 0.2 to 1.2 inches and the center-to-center distance A between adjacent sensors may be about 1 to 4 inches. The array is preferably secured to the lower portion of the gauge sensing means 40 by any convenient means such as angle iron 44 which has an opening in it to permit wire 48 which energizes the array and receives information therefrom to be operatively connected to the sensors. A series of such wires (not shown) would generally be employed with one being employed for each sensor.

The array, in the form shown, has a generally channel shaped outer frame 50. A support material 52 which is electrically nonconductive is interposed between the individual sensor 54 (FIG. 3) which has upper extremity 55 and the outer frame 50. As is shown in FIG. 4 a plurality of sensors 60–78 (even numbers only) are positioned within the array with a center-to-center spacing A. While any noncontacting sensors suitable for measuring the distance between the sensor and the lower surface of the strip 30 may be employed, it is preferred that an inductive displacement transducer array be used. A suitable sensor for this purpose is that marketed by Kaman Sciences Corporation under the designation KD-2310. The sensors should preferably have high resolution, good linearity and high speed.

The angle iron 44 may be secured to the gauge sensor 40 by any suitable means such as by welding or mechanical fasteners, for example. Consideration should be given to the quickness with which the sensor array may be removed and replaced without requiring a prolonged shutdown of the mill. If desired, the sensor array may be permanently secured by means of angle 44 to the gauge means 40 which in turn may have spaced wheels 84, 85 secured to the lower extremity thereof. Wheels 84, 85 cooperate with track means 86 to permit relative movement therebetween in a direction moving in and out of the page. Track means 86 has a base portion 87 on which wheels 84, 85 roll and upstanding guides 88, 89 which keep the wheels 84, 85 on base portion 87. In this manner, by this rolling action transverse to the direction of strip flow, rapid removal of the gauge and shape sensors may be readily achieved.

In general shape of the strip is measured by determining strip flatness within certain longitudinal sectors or stripes of the strip at at least two spaced transverse locations by means of arrays of sensor means. The number of sensors within an array will equal the number of stripes monitored. For example, an array of eight sensors at a particular location within the mill will measure flatness of the strip at eight locations. As the strip moves the eight sensor locations will monitor flatness on eight stripes. Sensor arrays are provided at at least two locations on the mill such as one array disposed immediately downstream of the first mill stand and a second array disposed immediately downstream of the last stand. Additional sensor arrays or different sensor positions may be employed, if desired.

Strip flatness $I_i$ for a given strip i, may be determined by the known equation $$I_i = \Delta L_i / L_i = aW_i^2 a(R_i/L_i)^2 \quad (1)$$

wherein $\Delta L_i$ = difference between the stripe length and that of flat stripe $L_i$ = length of one strip wave cycle $W_i$ = stripe waviness $R_i$ = total wave amplitude a = constant The strip flatness parameters measured at the upstream mill location are then compared with the tolerance values in the shape controller 18. If the measured values of the strip flatness parameters depart from the tolerance values, the shape controller 18 will calculate the roll gap profile corrections for each downstream mill stand taking into account the strip thickness, strip width, roll separating force as well as the mill design parameters. These feedforward corrections will be applied at the time when the portion of the strip measured at the upstream mill location will arrive to each downstream mill stand. According to the theory of plasticity, the strip profile changes can be made only within limited range without detrimental shape disturbances.

Therefore, there may be instances when allowable roll gap corrections at downstream mill stands will not be sufficient. In that case, shape controller 18 will calculate the roll gap profile corrections for each upstream mill stand. These feedback corrections will be applied upstream immediately after calculations are being made by shape controller 18.

The strip flatness parameters measured after last mill stand may be used for the following purposes: (a) to evaluate the final strip profile, (b) to generate the trim feedback roll gap profile corrections for the last mill stand, and (c) to generate the short-term and long-term adaptive constants for strip shape model.

Figure 5:
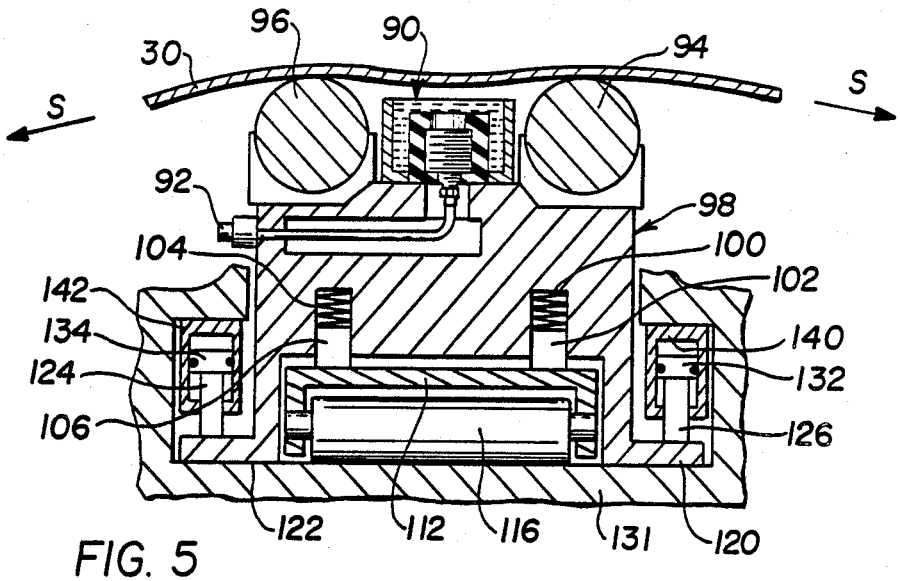
FIG. 5 is a schematic cross-sectional illustration of a sensor arrangement of the present invention.

Referring to FIG. 5 there is shown a strip 30 which is under tension indicated by the arrows labeled "S". A single linear array of sensors 90 which may be of the type hereinbefore described and illustrated, is disposed in spaced positions transversely across the the strip 30 so as to provide readings with respect to a series of stripes. The strip 30 is supported by a pair of rollers 94, 96 which are suitably journaled for axial rotation, are generally parallel to each other and are on opposite sides of the array of sensors 90. The sensor array is energized through contact 92. Support member 98 underlies and supports the rolls 94, 96 and the array of sensors 90. Springs 100, 104 are provided within a recess of support member 98 and are supported on pedestals 102, 106, respectively. These springs 100, 104 exert pressure on the support member 98 and frame 112 which rotatably supports a number of spaced rollers 116 (only one roller 116 has been shown.) Hydraulic clamp cylinders 140, 142, when pressure is being applied to the top surface of pistons 132, 134 would push the portions 120, 122 of support 98 down to foundation 131 through plungers 124, 126. When support member 98 with array of sensors 90 are to be removed, the pressure in the cylinders 140, 142 will be relieved thereby causing the force of springs 100, 104 to lift the support member 98 and permit it to be moved on rollers.

Figure 6:
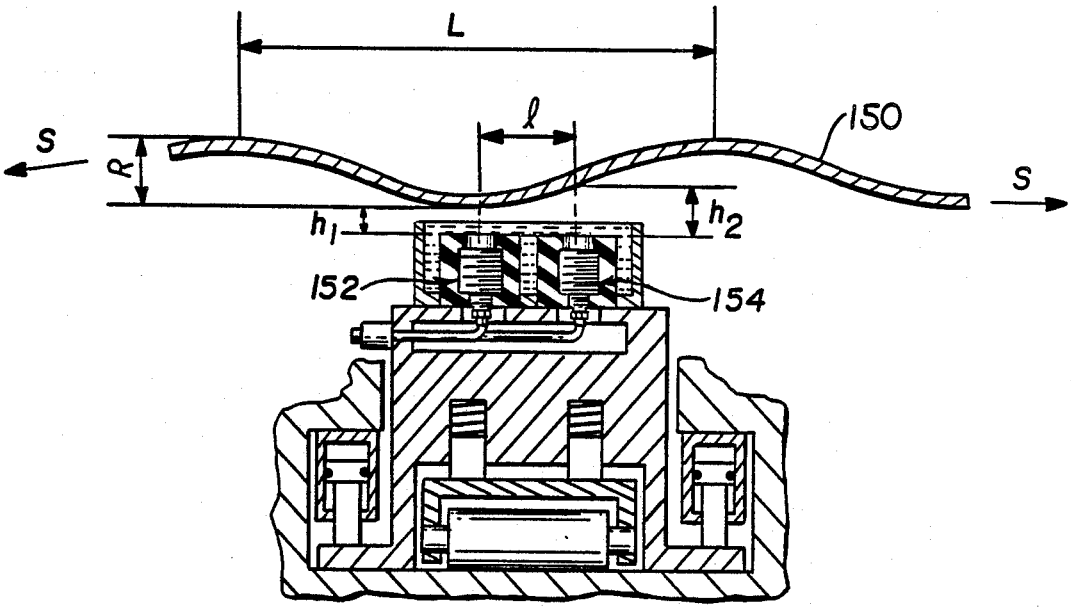
FIG. 6 is a schematic cross-sectional illustration similar to FIG. 5, but showing an embodiment employing two arrays of sensors.

Referring to FIG. 6 there is shown a strip 150 with the tension S being in a longitudinal direction. Two arrays of sensors 152, 154 are disposed in close adjacency with respect to each other with one array being downstream of the other and both arrays being oriented generally transversely with respect to the strip. The support structure may be essentially the same as that shown in FIG. 5 and function in the same manner. The distance $h_1$ is the distance between the uppermost portion of the sensors 152 and the lower surface of the strip 150 at that point and the distance $h_2$ is the distance between the lower surface of the strip 150 overlying sensor 154 and sensor 154. The dimension 1 represents the center-to-center spacing between the sensors in array 152 and the sensors in array 154. The dimension R equals the total wave amplitude which is the maximum departure from planar configuration within the strip in a given zone and the dimension L represents a full cycle of undulation of the strip 150. The use of two arrays of sensors minimizes undesired errors due to temperature and strip hardness variations.

Figure 7:
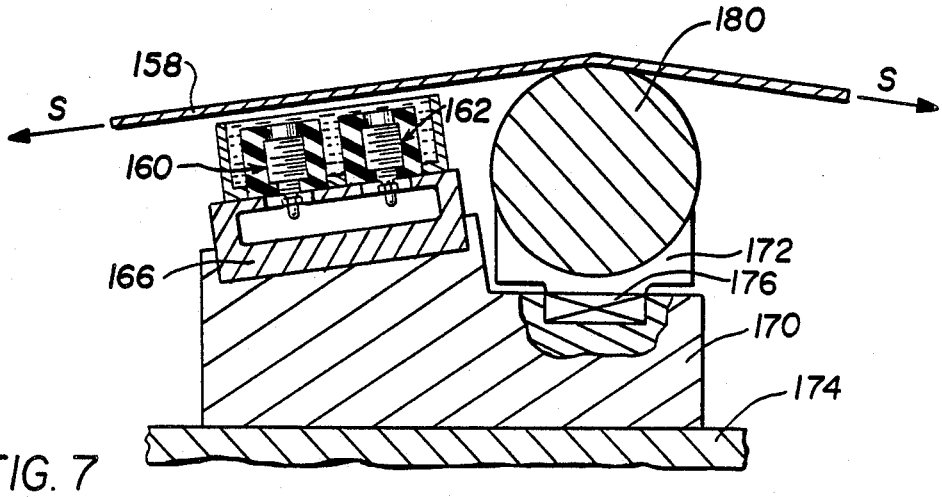
FIG. 7 is a schematic cross-sectional illustration of another embodiment employing two sensor arrays.

Referring to FIG. 7 there is shown a modified form of double array system wherein a strip 158 is under attention S in a longitudinal direction and a pair of generally parallel transversely located arrays of sensors 160, 162 are in spaced underlying relationship with respect to the strip 158 and are supported in a base member 166. In all of the double array assemblies, it is preferred that the sensors of one array be generally aligned with the sensors of the next adjacent array in order that the same stripe may be measured by both arrays. A support member 170 holds base member 166 and also supports journal 172 which rotatably supports roll 180. A series of load cells 176 are provided under journals 172 to measure total strip tension adjacent to shape sensors. Roll 180 serves to facilitate maintaining the desired gap between the upper portion of the sensor array and the lower surface of the strip.

Figure 8:
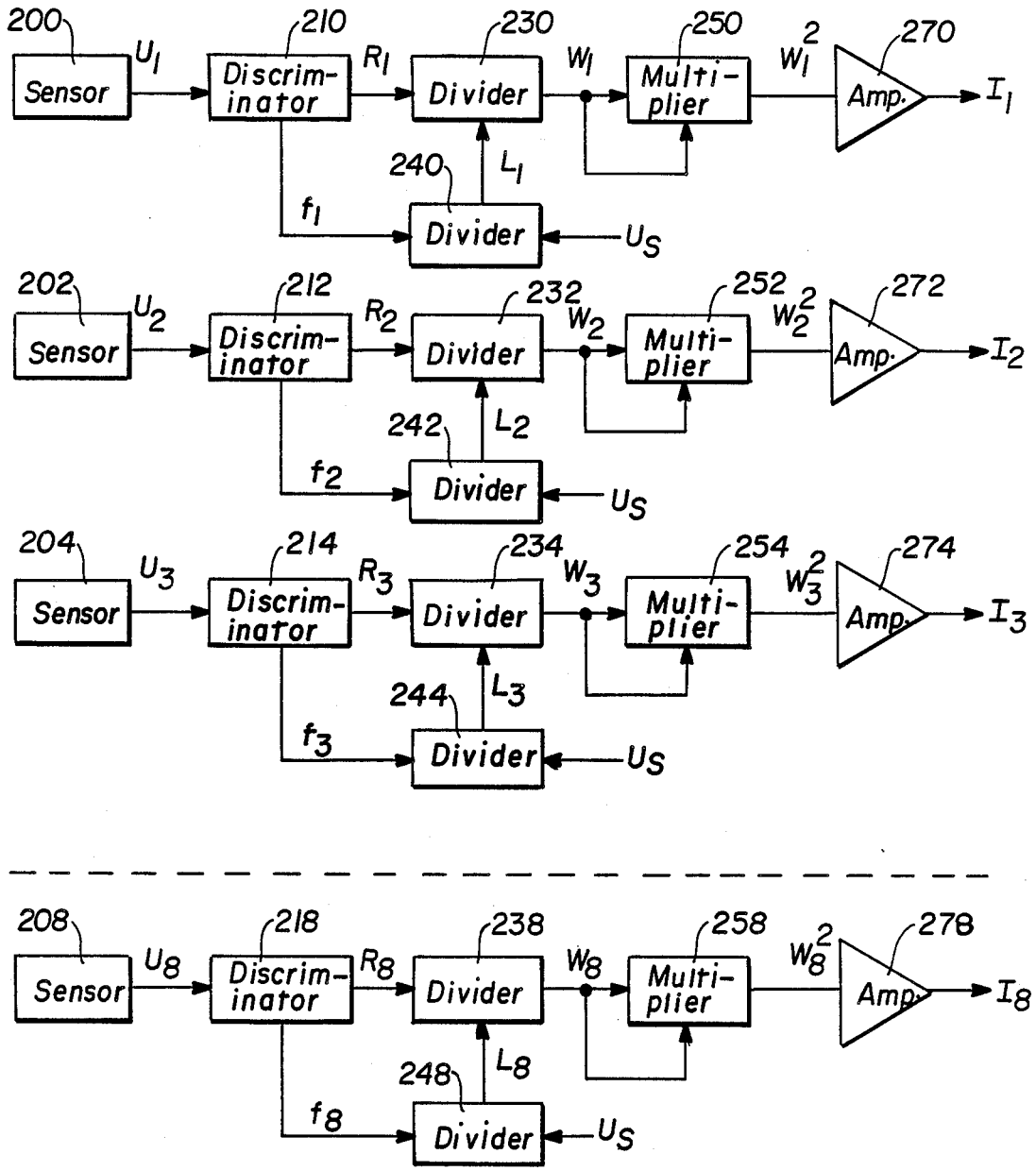
FIGS. 8 and 9 illustrate flow diagrams representative of signals processed, respectively, in single and double sensor array systems.

Referring to FIG. 8 there is shown schematically the manner in which a single row of sensors numbering eight (with the first three and eighth being shown but it being understood that each of the components for each sensor may be substantially the same). The sensors 200, 202, 204, 208 generate signals $U_i$ which are the signals representing the distances between the sensors and the bottom surface of the stripes positioned over the array of sensors. The signals from each sensor 200–208 can be expressed as follows: $U_i = R_i/2 \sin(2\pi f_i t)$ wherein t equals time. The discriminators 210, 212, 214, 218 invert the $U_i$ signal into two signals $R_i$, $F_i$. $R_i$ is proportional to the amplitude of the wave or the departure from flatness of the stripes positioned over the array of sensors. Signal $f_i$ is proportional to the frequency of the wave.

Divider 240, 242, 244, 248 calculates the stripe shape wavelength according to the equation $$L_i = U_s/f_i$$

wherein $U_s$ = signal proportional to the strip speed. The resultant $L_i$ is delivered from dividers 240, 242, 244, 248 to dividers 230, 232, 234, 238, respectively. Divider 230, 232, 234, 238 calculates the stripe shape waviness according to the equation $$W_i = R_i/L_i.$$

Both inputs to multiplier 250 provide input value $W_i$. Therefore, multiplier 250 emits a signal corresponding to $W_i^2$. Scaling amplifier 270 calculates the flatness parameter $I_i$ according to equation (1). Similarly, multiplier 252 and amplifier 272 produce flatness parameter $I_2$, multiplier 254 and amplifier 274 cooperate to produce flatness parameter $I_3$ and multiplier 258 cooperates with amplifier 278 to produce flatness parameter $I_8$.

It will be appreciated that while only the first three and last of the eight sensors 200, 202, 204, 208 have been illustrated, a substantially identical additional four subsystems disposed between sensor 204 and sensor 208 may be provided if it is desired to provide a total of eight sensors measuring strip flatness along stripes.

Figure 9:
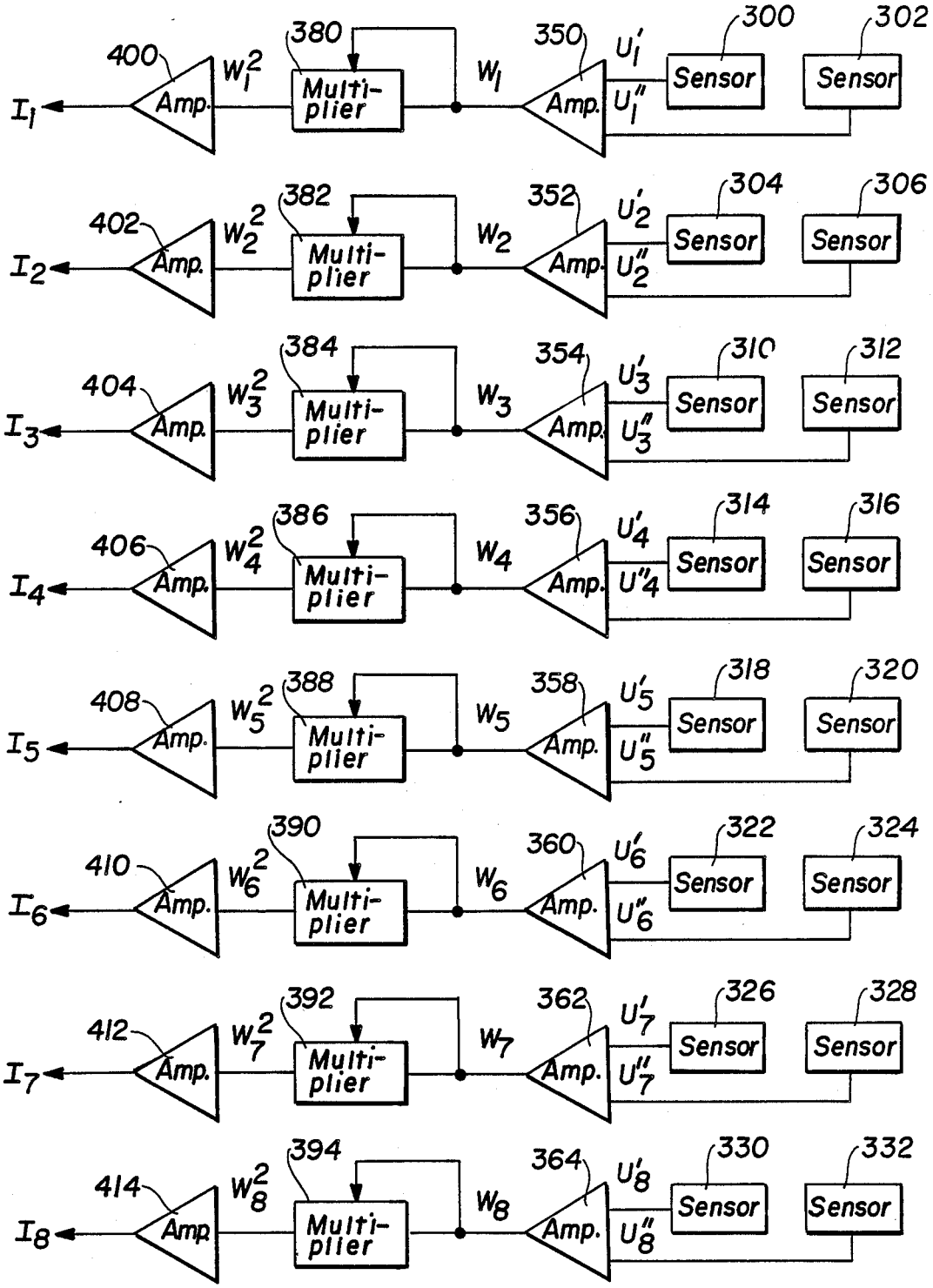

Referring to FIG. 9 there is shown schematically a system wherein two adjacent arrays of sensors are employed as in the system shown in FIGS. 6 and 7, for example. As shown in FIG. 9, there are eight separate sensor stations each of which measures the flatness of a stripe in the strip and at each station there are two adjacent sensors. For example, adjacent sensors 300, 302 emit, respectively, signals $U_1'$ and $U_1''$. These two signals are received by differential amplifier 350 which emits a waviness signal $W_1$ to multiplier 380 which produces a signal representing the square of the signal and scaling amplifier 400 which produces a strip flatness parameter $I_1$. Similarly, pairs of sensors 304–306, 310–312, 314–316, 318–320, 322–324, 326–328, and 330–332 produce, respectively, signals $U_2'-U_2''$, $U_3'-U_3''$, $U_4'-U_4''$, $U_5'-U_5''$, $U_6'-U_6''$, $U_7'-U_7''$ and $U_8'-U_8''$ which signals in turn, respectively, are processed by differential amplifiers 352, 354, 356, 358, 360, 362, 364 with the resultant output of these amplifiers being processed respectively by multipliers 382, 384, 386, 388, 390, 392, 394 and scaling amplifiers 402, 404, 406, 408, 410, 412, 414, to yield, respectively, strip flatness parameters $I_2$, $I_3$, $I_4$, $I_5$, $I_6$, $I_7$, $I_8$, respectively.

The signals from the double rows of sensors may each be expressed as follows:

$$U_i' = (R_i/2) \sin (2\pi f_i t)$$

$$U_i'' = (R_i/2) \sin (2\pi f_i t - \alpha)$$

wherein $R_i$ = the total wave amplitude, f = the frequency of the stripe shape variation, t = time, and $\alpha$ is the phase lag between the signal $U_i''$ measured by the downstream sensor and the signal $U_i'$ measured by the upstream sensor.

The difference between signals $U_i'$ and $U_i''$ is equal to $(U_i' - U_i'') = R_i \cos (2\pi f_i - \alpha/2) \sin (\alpha/2)$. The amplitude of this differential signal is equal to $$U_1' - U_1'' = R_i \sin (\pi 1/L_i)$$

wherein 1 = the distance between the two rows of sensors. When 1 is substantially less in magnitude than L, the expression for the differential may be reduced as follows:

$$U_1' - U_i'' = R_i/L_i \times \pi 1 = W_i \pi 1.$$

As a a result, $W_i = (U_i' - U_i'')/(\pi 1)$. The differential amplifier performs the calculations according to this last equation. The multiplier with the scaling amplifier calculates the flatness parameter according to equation (1).

One of the advantages of the double row of sensors is that it minimizes error due to temperature and material hardness variation in the longitudinal directions as two sets of readings, one from each sensor array, are being taken.

Figure 10:
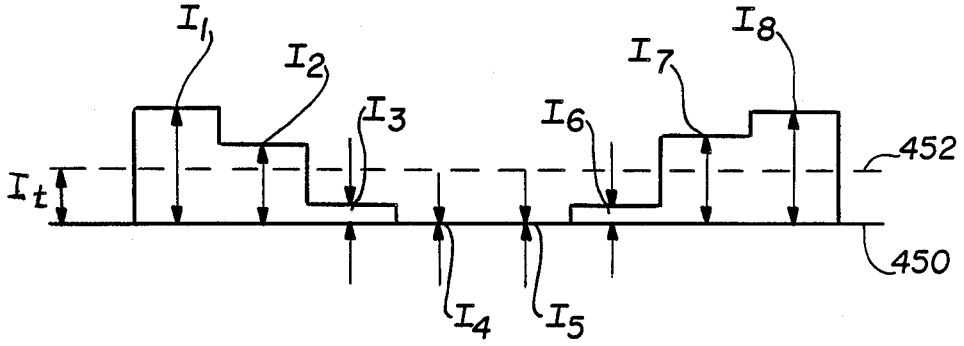
FIG. 10 is a graphic presentation of the output signals from the apparatus of the present invention.

Referring to FIG. 10 there is shown schematically a base line 450 and a dashed line 452 which represents a permissible range of tolerances for the strip flatness parameter I as indicated by dimension $I_t$. The solid lines adjacent to the letters $I_1$, $I_2$, $I_3$, $I_4$, $I_5$, $I_6$, $I_7$, $I_8$ show the specific strip flatness parameters as determined by actual readings by the sensors. As will be appreciated, the readings for $I_1$, $I_2$, $I_7$ and $I_8$ exceed the permissible tolerances while the readings for $I_3$, $I_4$, $I_5$ and $I_6$ are within the permitted tolerances.

Figure 11:
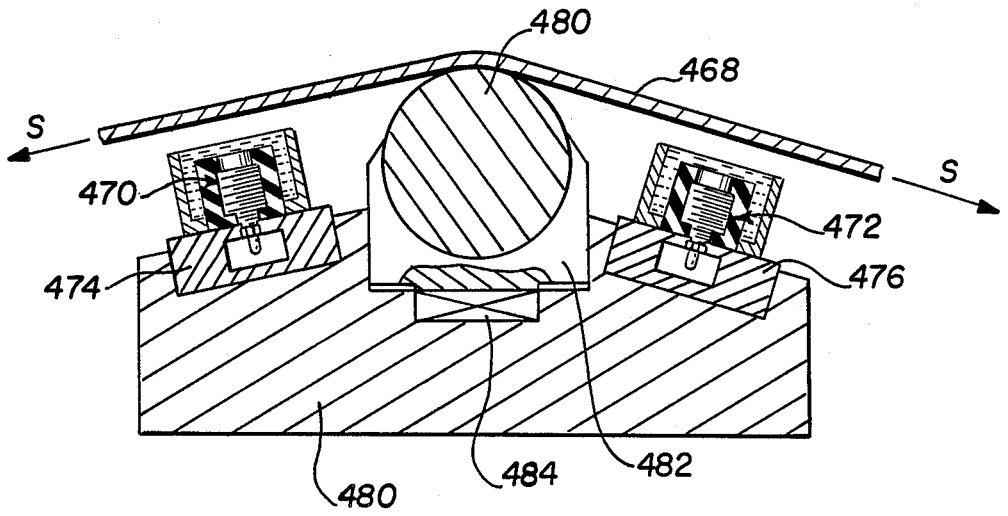
FIG. 11 is a schematic cross-sectional illustration of a modified form of two sensor array apparatus.

Referring to FIG. 11 there is shown another form of the invention wherein a strip 468 is under a tension S and two arrays of sensors 470, 472 are each supported respectively, on support members 474, 476 which in turn are secured within sensor base 480. A roll member 480 is axially rotatably journaled within support 482 which overlies load cell 484. It will be appreciated that the roll 480 serves to urge the strip 468 upwardly and that the arrays of sensors 470, 472 are biased so as to be generally parallel to the adjacent surface of sheet portion 468. As the roll member 480 tends to flatten the strip and therefore to disturb the reading, it is preferable to locate the sensors symmetrically with respect to the roll member 480 in order that the effect of this disturbance can be cancelled.

In the method of the present invention the rolling mill has a first mill stand and at least one additional stand. The strip shape is monitored by first sensing means disposed adjacent to and preferably downstream of the first mill stand and the strip shape is also monitored by second shape sensing means disposed adjacent to and preferably downstream of the last mill stand. The shape related signals are provided to controller means. The controller means make a comparison between stored information and the signals received and if the actual reading departs from the stored information by a predetermined amount emits a control signal to alter the roll bite. In a preferred embodiment the comparison and stored information are provided in a computer and the control signal emitted responsive to the need for change is provided to servovalves which control the roll bending cylinders through the roll bending servovalves controller. Similar feedback information is provided by the gauge sensing means disposed adjacent to the shape sensing means.

It will be appreciated that the present invention provides an effective and rapid means for controlling gauge and shape of a strip through a multistand rolling mill. All of this is accomplished by means of specifically preferred noncontacting sensors which are disposed at the upstream and downstream portions of the mill stand and cooperate with a computer to effect changes in the roll bending cylinders. The invention does not require major alterations to existing rolling mill constructions.

While for convenience of reference herein sensors have been shown as being positioned at two locations, it will be appreciated that additional arrays may be employed if desired.

Whereas particular embodiments of the invention have been described above for purposes of illustration, it will be appreciated by those skilled in the art that numerous variations of the details may be made without departing from the invention as described in the appended claims.

I claim:

1. A strip rolling mill comprising:

a mill stand for rolling strip traveling on a predetermined path of travel and having shape variations, said mill stand having a pair of work rolls forming a roll bite and roll bite contour actuator means for altering the roll bite contour, first shape sensor means arranged downstream of said mill stand for providing signals corresponding to shape variations of the strip at a first position with respect to said mill stand, second shape sensor means disposed downstream of said first shape sensor means for producing signals corresponding to the shape variations of the strip at a second position, said first and second sensor means being arranged relative to said traveling strip such that the spatial relationship of said first and second sensor means relative to said path of travel of the strip is less than the spatial relationship between two succeeding similar reference points of the shape variations of the passing strip, and controller means for receiving said shape signals from said first shape sensor means and said second shape sensor means and emitting a responsive output signal to said mill stand when shape correction is to be effected.

2. A strip rolling mill of claim 1 wherein said arranged relationship of said first and second sensor means follows the equation:

$$W_i=(U_i'-U_i'')/(\pi 1)$$

where $W_i$=strip shape waviness $U_i'$=output signal from the first sensor means $U_i''$=output signal from the second sensor means, and l =distance between the first and second sensor means.

3. The rolling mill of claim 1 including at least one said shape sensor means having an array of sensors spaced with respect to each other and extending generally transversely to the direction of strip travel, whereby each said sensor will monitor shape within a longitudinal stripe of said strip.

4. The rolling mill of claim 1 including each said shape sensor means having two said sensor arrays.

5. The rolling mill of claim 4 including said two sensor arrays being disposed generally parallel to each other with the sensors of one array aligned with the sensors of the other, whereby both said arrays will monitor the same stripes of said strip.

6. The rolling mill of claim 1 including said first shape sensor means and said second shape sensor means each having an array of noncontacting sensor.

7. The rolling mill of claim 6 including sensor arrays each being a group of inductive displacement transducers.

8. A system for measuring strip shape variations of a strip traveling in a predetermined path, comprising:

first shape sensor means arranged in said system for providing signals corresponding to shape variations of the strip at a first position with respect to said system, second shape sensor means disposed downstream of said first shape sensor means for producing signals corresponding to the shape variations of the strip at a second position, said first and second sensor means being arranged relative to said traveling strip such that the spatial relationship of said first and second sensor means relative to said path of travel of the strip is less than the spatial relation between two succeeding similar reference points of the shape variations of the passing strip, and controller means for receiving said shape signals from said first shape sensor means and said second shape sensor means and emitting a responsive output signal to said system when shape correction is to be effected.

9. A system of claim 8, wherein said arranged relationship of said first and second sensor means follows the equation:

$$W_i=(U_i'-U_i'')/(\pi l)$$

wherein $W_i$ =strip shape waviness $U_i'$=output signal from the first sensor means $U_i''$=output signal from the second sensor means, and l=distance between the first and second sensor means.

* * * * *

UNITED STATES PATENT AND TRADEMARK OFFICE

CERTIFICATE OF CORRECTION

PATENT NO. : 4,771,622

DATED : September 20, 1988

INVENTOR(S) : VLADIMIR B. GINZBURG

It is certified that error appears in the above-identified patent and that said Letters Patent is hereby corrected as shown below:

Column 4, line 46, in the equation, an equals sign -- = -- should be inserted before "$a(R_i/L_i)^2$".

Column 6, line 21, "$F_i$" should be --$f_i$--.

Column 7, line 22, --t-- should be inserted after "$f_i$".

In Claim 6, the last word should be --sensors--.

Signed and Sealed this

Third Day of October, 1989

*Attest:*

*Attesting Officer*

DONALD J. QUIGG

*Commissioner of Patents and Trademarks*